United States Patent [19]

Hughes

[11] Patent Number: 4,762,049

[45] Date of Patent: Aug. 9, 1988

[54] FEED SYSTEM FOR LINKED AMMUNITION

[75] Inventor: Rodney V. Hughes, Stafford, England

[73] Assignee: Lucas Industries plc, Birmingham, England

[21] Appl. No.: 937,110

[22] Filed: Dec. 2, 1986

[30] Foreign Application Priority Data

Dec. 31, 1985 [GB] United Kingdom ..... 8531957

[51] Int. Cl.[4] ..... F41D 10/40

[52] U.S. Cl. ..... 89/33.14; 89/33.5; 89/37.16; 193/25 AC

[58] Field of Search ..... 89/33.1, 33.14, 33.16, 89/33.17, 33.2, 33.25, 33.5, 37.16; 193/25 AC

[56] References Cited

U.S. PATENT DOCUMENTS 2,479,633 8/1949 MacKenzie ..... 89/33.5
2,550,837 5/1951 MacKenzie ..... 89/33.5

FOREIGN PATENT DOCUMENTS 459014 12/1936 United Kingdom ..... 89/33.16
2149069 6/1985 United Kingdom ..... 89/37.16

*Primary Examiner*—Stephen C. Bentley
*Attorney, Agent, or Firm*—Trexler, Bushnell, Giangiorgi & Blackstone, Ltd.

[57] ABSTRACT

A belt of linked cartridges is supplied to a traversable gun by way of flexible chutes, one of which is secured at its respective ends to a relatively fixed part and to a structure which is traversable with the gun. The chute so secured has a loop which rests on a support element and is of sufficient length to accommodate the full range of traverse of the gun.

4 Claims, 4 Drawing Sheets

FEED SYSTEM FOR LINKED AMMUNITION

Machine guns are commonly supplied with ammunition which is linked to form a belt. The ammunition belt must either be carried in or on the gun mounting or be supplied from a relatively stationary container. In cases where the gun mounting itself is required to be small it may be impossible to locate the container in or on the mounting. Additionally, if the mounting is to be carried by a comparatively light aircraft it is desirable that the ammunition container shall be sited relatively close to the aircraft center of gravity. Both of the foregoing constraints may require relatively long belt runs between the container and the gun. Traversing of the gun requires that the ammunition belt shall be able to form loops which do not impose excessive pull which may cause its links to break or the gun to stall. If the gun has a wide arc of traverse these loops will have large changes in their configuration and these cahnges should preferably be accommodated in a small volume.

It is an object of the invention to provide an ammunition feed system in which the foregoing requirements are met.

According to the invention a feed system for supplying a belt of linked cartridges to a traversable gun comprises a relatively fixed substantially horizontal and substantially planar element, means for guiding said belt onto said element so that said element can support cartridges, and means for guiding said belt away from said element towards the breech of said gun, the area of said element being sufficiently large as to support loops formed in said belt over the expected range of traverse of said gun.

In a preferred embodiment said means for guiding said belt onto and away from said element comprise first and second flexible chutes.

In a further preferred embodiment said means for guiding the belt away from said elementncludes means for driving said cartridges towards the breech of said gun at a speed compatible with the rate of fire of said gun.

Figure 1:
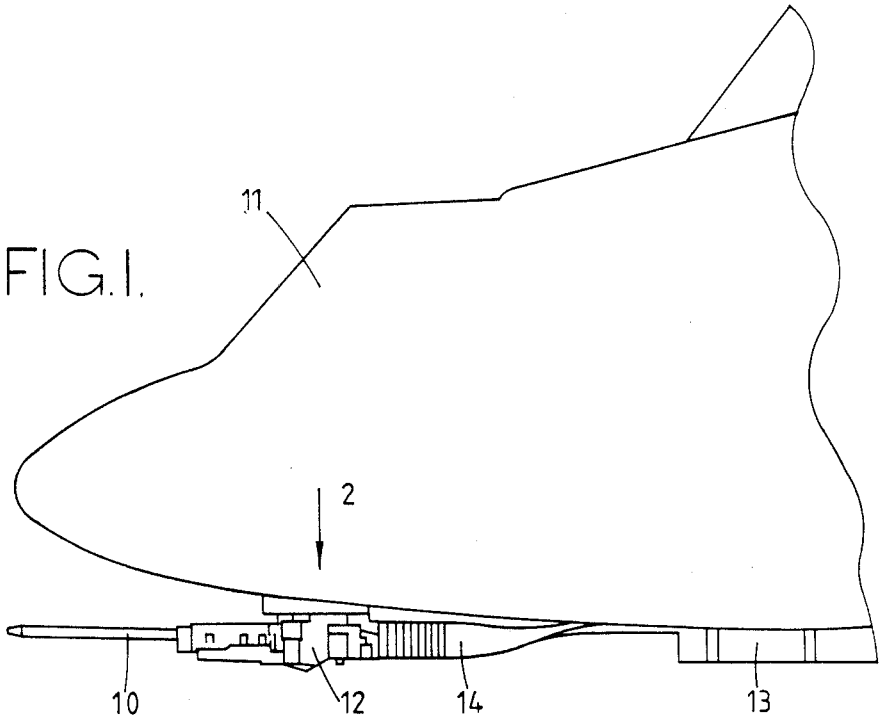
Figure 2:
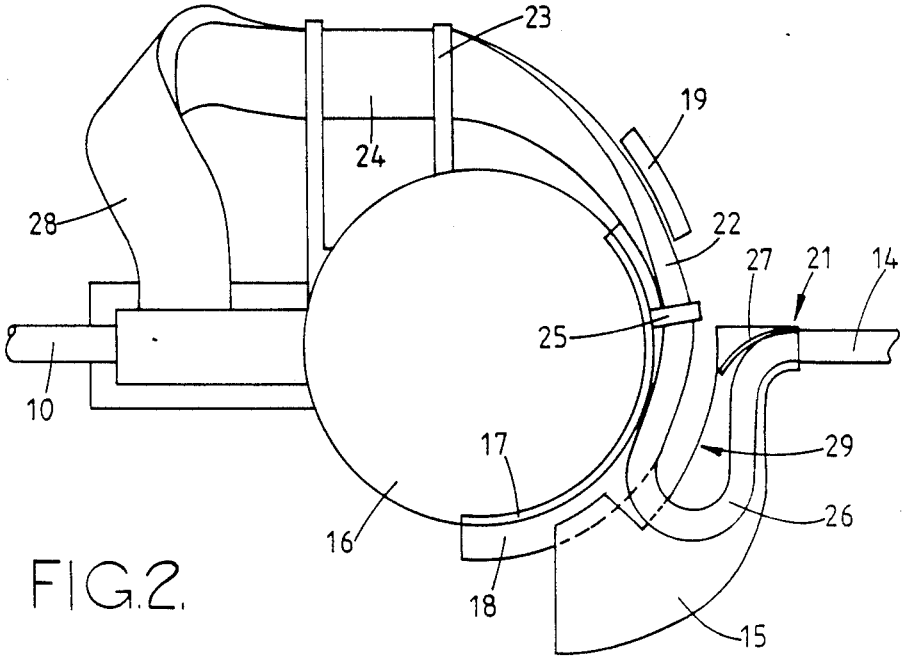
Figure 3:
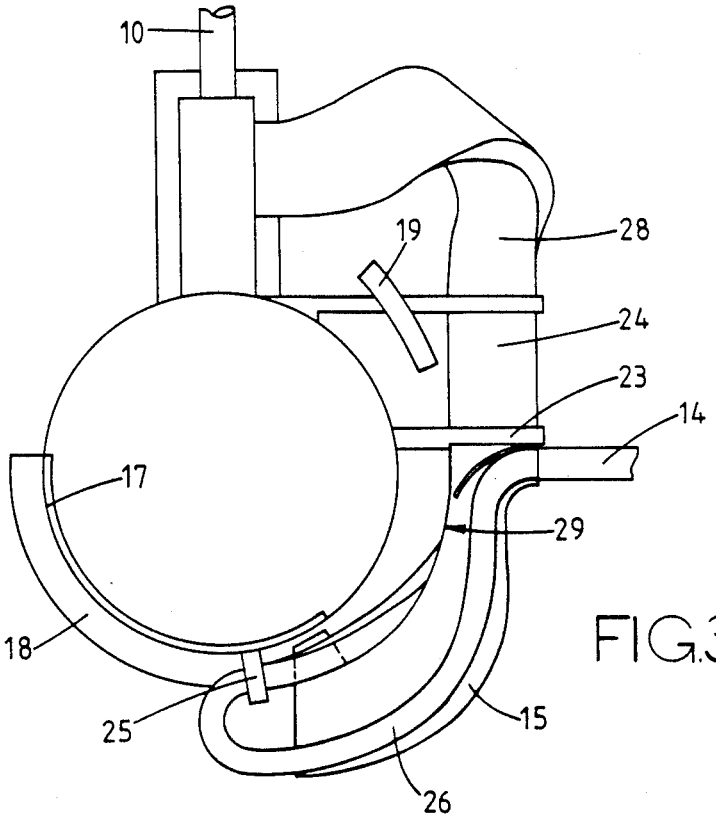
Figure 4:
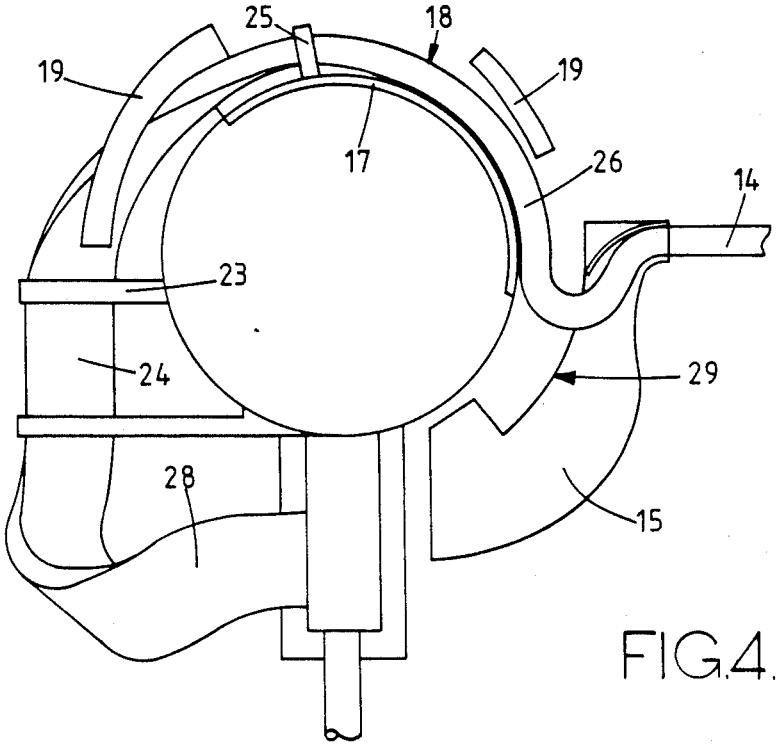
Figure 5:
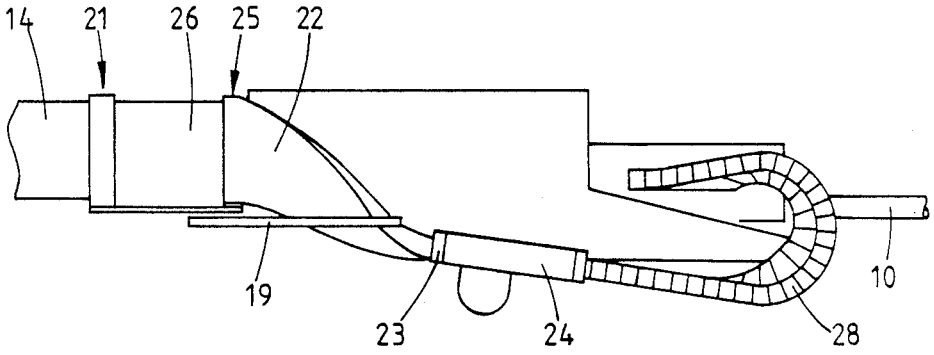
Figure 6:
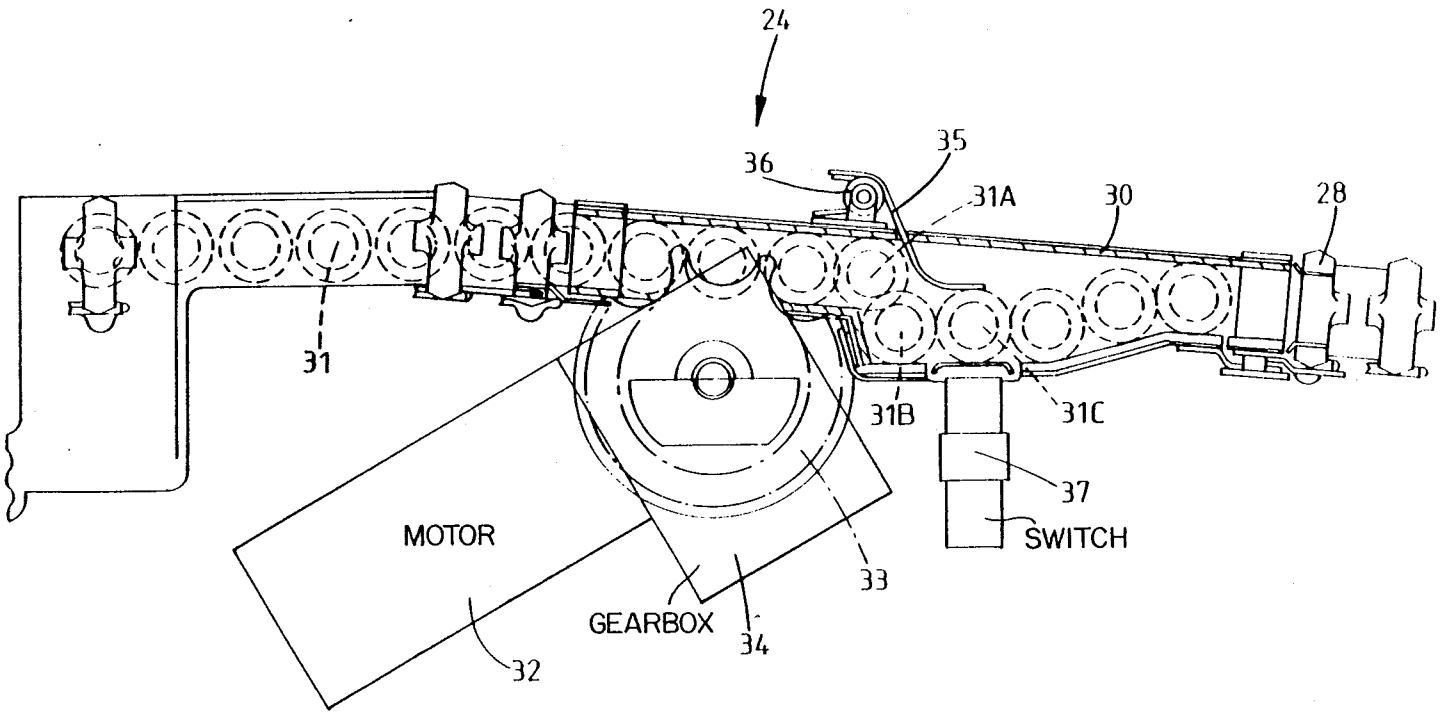

An embodiment of the invention will now be described by way of example only and with reference to the accompanying drawings in which:

FIG. 1 shows a machine gun mounted beneath the nose of a helicopter,

FIG. 2 is a diagrammatic plan view of the gun and associated ammunition feed system, viewed on arrow 2 in FIG. 1, FIGS. 3 and 4 are views, corresponding to FIG. 2, of the gun trained respectively clockwise and anticlockwise from the position in FIG. 2, and FIG. 5 is an elevation on arrow 5 in FIG. 2, and FIG. 6 shows details to an enlarged scale of an ammunition drive and feed detector system.

As shown in FIG. 1 a machine gun 10 is located under the nose of a helicopter 11 by means of a mounting 12 which in addition to permitting the gun 10 to be elevated and lowered through a total range of 50° enables it to be traversed 90° on either side of the center line of the helicopter 11. Ammunition linked in a belt is supplied to the gun 10 from a container 13 which is located under the helicopter 10 adjacent its centre of gravity. The ammunition is conveyed from the container 13 to the mounting 12 through a flexible chute 14 of a type commercially available from Nobles Industries Inc., St. Paul, Minn. The connections of the chute 14 tot he mounting 12 and container 13 do not move relatively but the flexibility of the chute 14 allows for dimensional tolerances and vibration.

As shown in FIG. 2 the mounting 12 includes a stationary support element 15 and a rotatable turret 16 on which the gun 10 is carried. A circumferential wall 17 on the turret 16 extends approximately 120° around the turret 16 and has a L-shaped section whose shorter limb forms a horizontal flange 18. The wall 17 and the flange 18 rotate with the turret 16.

The chute 14 has a 90° twist so that cartridges pass over the element 15 with their points directed downwardly towards that element. The chute 14 is secured to the element 15 at 21 and a further chute 22, having the same construction as the chute 14, has one of its end secured at 21 to the chute 14 and is aligned therewith, to receive cartridges from the chute 14. The other end of the chute 22 is secured by a bracket 23 to the wall 17 and is aligned with a cartridge driving and monitoring unit 24, to be described in detail with reference to FIG. 6. The chute 22 is also secured between its ends to the turret 16 by a clamp 25, the portion 26 of the chute 22 between the clamp 25 and the location 21 resting on the element 15 as a loop, the formation of this loop on the element 15 being ensured by an arcuate guide 27. A part 19 is fixedly mounted relative to the element 15 to prevent excessive looping of the chute portions 26 during movement of the turret from the position shown in FIG. 4 to the position shown in FIG. 2.

Between the clamp 25 and bracket 23 the chute 22 is twisted through 90° about its longest axis and is also bent through 90° as shown in FIG. 2 and is directed downwardly as shown in FIG. 5, so that the bracket 23 and unit 24 lie below the plane of the flange extension 19. A third flexible chute 28 is secured to an aligned with the device 24 to receive cartridges therefrom, the chute being bent over and back to supply cartridges in their proper orientations to the breech of the gun 10.

As shown in FIG. 2 with the gun 10 directed forwardly of the aircraft 11, the looped portion 26 of the chute 22 extends only part way over the element 15. With the gun traversed at 90° to starboard, as shown in FIG. 3, the loop 26 extends across the whole of the element 15 and projects therefrom, being supported by the clamp 25 and flange 18. In this position a cut-out 29 in the element 15 is positioned so that the portion of the chute 22 between the clamp 25 and bracket 23 can pass downwardly to the unit 24.

With the gun 10 trained 90° to port as shown in FIG. 4 the loop 26 lies almost wholly on the flange 18 and only a short run of this loop is supported by the element 15.

The unit 24 is shown in FIG. 6 and comprises a rigid housing 30 within which cartridges 31 can be conveyed between the chutes 22, 28. Mounted on the housing 30 is an electric motor 32 which drives a sprocket wheel 33 through an angle-drive gearbox 34. The teeth of the sprocket wheel 33 are spaced apart so as to receive and locate successive cartridges 31. The speed of rotation of the wheel 33 is such that cartridges are moved through the unit 24 at a speed which is greater than that required by the rate of fire of the gun. As is well known the links between the cartridges 19 are such as to permit these cartridges to be accordion-folded. The housing 30 includes a portion of increased cross section by means of which a cartridge 31A can ride over a preceding cartridge 31B to engage a cartridge 31C two places in advance. When this happens the cartridges 31A and 31C are pushed downwardly by an arm 35 biased by a torsion spring 36 to operate a switch 37 which de-energises the motor 32.

The motor 32 is restarted when firing of the gun 10 pulls the cartridges 31 back into the configuration shown in the drawing. The device 24 as a whole thus maintains a cartridge feed which is consistent with the rate of fire of the gun 10 and thereby avoids the ammunition pulling on the action of the gun 10 as a result of passage through the chutes 14, 22, 28.

I claim:

1. A feed system for supplying a belt of linked cartridges to a traversable gun, comprising a fixed substantially horizontal and substantially planar element with respect to which said gun is traversable and elevatable, means for guiding said belt onto said element so that said element can support said cartridges with the axes thereof substantially perpendicular to the plane of said element, and means for guiding said belt away from said element towards the breech of said gun, a flexible chute for guiding said belt between said means for guiding onto and away from said element, the area of said element being sufficiently large as to support loops formed in said flexible chute over the expected range of traverse of said gun.

2. A feed system for supplying a belt of linked cartridges to a traversable gun, comprising a relatively fixed substantially horizontal and substantially planar element, a first flexible chute for guiding said belt onto said element so that said element can support said cartridges, and a second flexible chute for guiding said belt away from said element towards the breech of said gun, the area of said element being sufficiently large as to support loops formed in said belt over the expected range of traverse of said gun.

3. A system as claimed in claim 2 which includes a further flexible chute for guiding cartridges between said first and second chutes, said further chute being supported by said planar elements.

4. A system as claimed in any of claims 2 or claim 3 which includes means for driving said cartridges towards the breech of said gun at a speed compatible with the rate of fire of the gun.

* * * * *